US007285014B2

(12) United States Patent
Castaldo et al.

(10) Patent No.: US 7,285,014 B2
(45) Date of Patent: Oct. 23, 2007

(54) CORD CONNECTOR HAVING A WATER-RESISTANT SEAL

(75) Inventors: Cosmo Castaldo, Westbury, NY (US); Patricia Roccaro, West Islip, NY (US)

(73) Assignee: Leviton Manufacturing Co., Ltd., Little Neck, NY (US)

( * ) Notice: Subject to any disclaimer, the term of this patent is extended or adjusted under 35 U.S.C. 154(b) by 0 days.

(21) Appl. No.: 11/299,774

(22) Filed: Dec. 13, 2005

(65) Prior Publication Data

US 2006/0134965 A1 Jun. 22, 2006

Related U.S. Application Data

(60) Provisional application No. 60/637,228, filed on Dec. 17, 2004.

(51) Int. Cl.
*H01R 13/40* (2006.01)

(52) U.S. Cl. ..... 439/589; 439/587

(58) Field of Classification Search ..... 439/274, 439/275, 462, 584, 587, 589, 638, 650
See application file for complete search history.

(56) References Cited

U.S. PATENT DOCUMENTS

| | | | | |
|---|---|---|---|---|
| 5,470,248 | A * | 11/1995 | Wood | 439/281 |
| 5,863,221 | A * | 1/1999 | Castaldo | 439/589 |
| 6,017,243 | A * | 1/2000 | Castaldo | 439/462 |
| 6,331,123 | B1 * | 12/2001 | Rodrigues | 439/584 |
| 6,371,807 | B1 * | 4/2002 | Takagishi et al. | 439/587 |
| 6,605,781 | B2 * | 8/2003 | Milanowski et al. | 174/74 R |
| 7,029,328 | B1 * | 4/2006 | Mckenzie et al. | 439/587 |

* cited by examiner

*Primary Examiner*—Thanh-Tam Le
(74) *Attorney, Agent, or Firm*—Paul J. Sutton

(57) ABSTRACT

A cord connector having a water-resistant seal that allows a cord to be connected to one or more connectors and then sealed in a water-resistant enclosure in a field installation or environment. The cord is received at a first opening of the enclosure which uses a sealing assembly comprising a nut, strain relief grommet and bushing to provide a water-resistant seal between the cord and the first opening of the enclosure. The connectors are received at a second opening of the enclosure and use a rubber seal to provide a water-resistant seal between the connectors and the second opening of the enclosure.

18 Claims, 7 Drawing Sheets

CORD CONNECTOR HAVING A WATER-RESISTANT SEAL

This application claims priority of U.S. provisional application having Ser. No. 60/637,228 filed Dec. 17, 2004.

BACKGROUND OF THE INVENTION

1. Field of the Invention

The present invention is directed to the field of electrical connectors and more particularly to a water-resistant electrical connector adapted for field installation.

2. Description of the Prior Art

Water resistance is a consideration in any installation of an electrical connector that is exposed to the elements. One approach to providing a water-resistant seal for an electrical connector has been to provide close tolerances between the outer surface of an electrical cord and the inner surface of a bore in a housing or connector to which the electrical cord was being affixed. To be effective, the housing or connector bore had to be smaller than the outer diameter of the cord so that the connector bore was dilated as the cord was forced into the connector bore. The close tolerance of the bore/cord interface provided the resistance against the infiltration of water into the connector. Often, undesired gaps between the housing and the connector would admit moisture into the connector which could ultimately lead to destruction of the connector and the failure of any connected system. Advances in the water resistance of electrical connector/housing interfaces have been made, however, these have largely relied on interface tolerances achieved during manufacture or during initial long-term installation. In field installations such as the repair of a cord or the installation of multiple outlets on a cord, there remains a need for effective solutions to water proofing electrical connector installations.

SUMMARY OF THE INVENTION

The present invention describes a cord connector for use in field installation including the repair of a cord or the installation of multiple outlets on a cord and the water proofing of such connector installations. In one embodiment, the cord connector allows a cord to be connected to one or more connectors, such as receptacles, plugs or a combination thereof, and then sealed in a water-resistant enclosure. The enclosure has a first opening for receiving the cord and provides a water-resistant seal between the cord and the enclosure by using a sealing assembly comprising a nut, strain relief grommet and bushing. The enclosure has a second opening for receiving the connectors and uses a rubber seal to provide a water-resistant seal between the connectors and the enclosure. The strain relief grommet and bushing can be part of a strip holding multiple rubber grommets and bushings for accommodating different size cords. The connectors are grouped into pairs of terminals where a first terminal is for connection to a conductor of the cord and a second terminal is for connection to another connector in the same housing which allows for parallel electrical connections. The connectors and the rubber seal include a keying mechanism to align the connectors in the same orientation in a multiple connector configuration.

The foregoing has outlined, rather broadly, a preferred blending feature, for example, of the present invention so that those skilled in the art may better understand the detailed description of the invention that follows. Additional features of the invention will be described hereinafter that form the subject of the claims of the invention. Those skilled in the art should appreciate that they can readily use the disclosed conception and specific embodiment as a basis for designing or modifying other structures for carrying out the same purposes of the present invention and that such other structures do not depart from the spirit and scope of the invention in its broadest form.

BRIEF DESCRIPTION OF THE DRAWINGS

Other aspects, features, and advantages of the present invention will become more fully apparent from the following detailed description, the appended claim, and the accompanying drawings in which similar elements are given similar reference numerals.

DETAILED DESCRIPTION OF THE INVENTION

The present invention discloses a water-resistant cord connector that allows a cord to be connected to one or more connectors and then sealed in a water-resistant enclosure. The cord connector is applicable in field installation where a cord is repaired or where a cord is connected to one or more connectors such as receptacles, plugs or a combination thereof.

Figure 1:
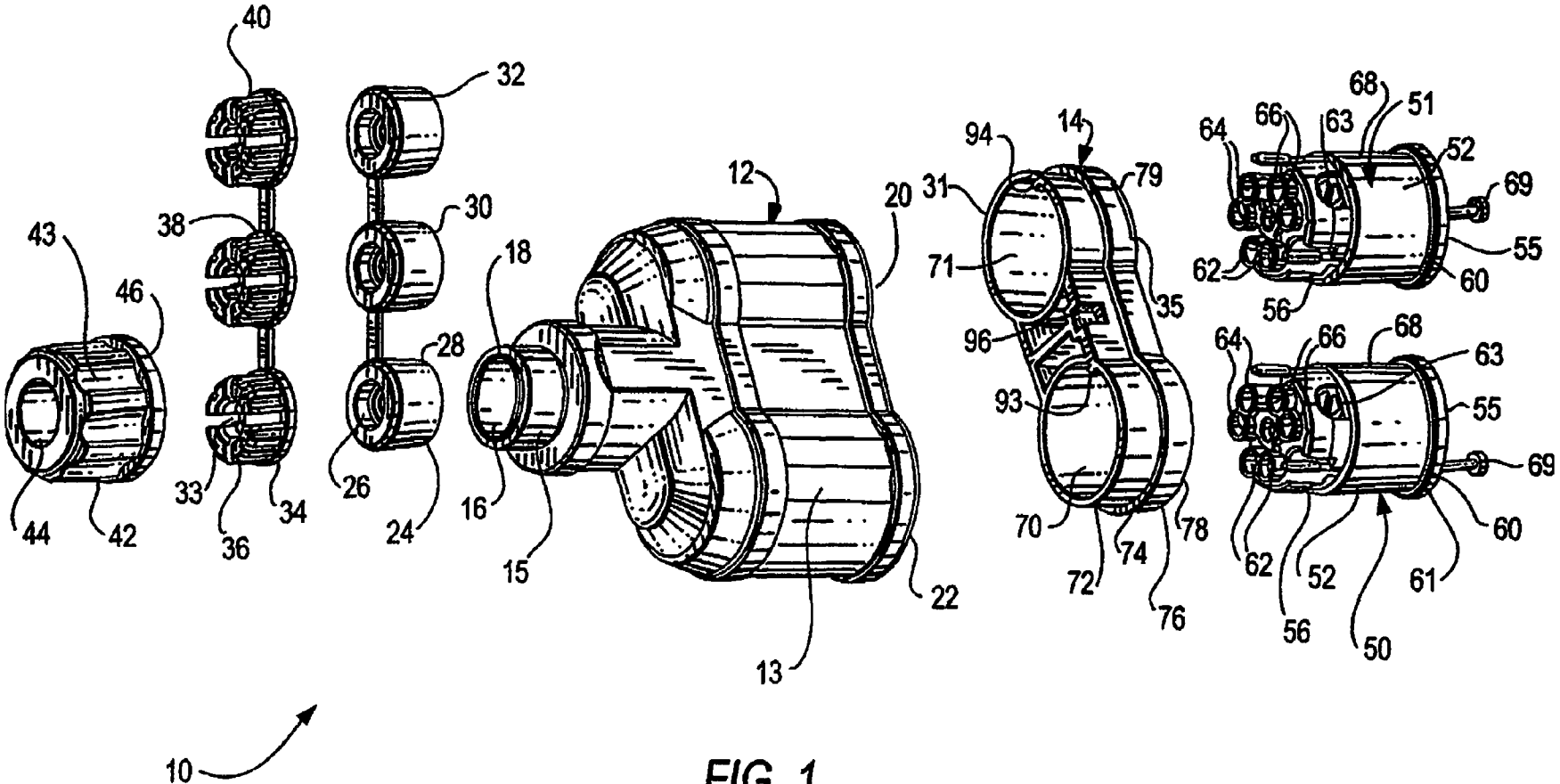
FIG. 1 is an exploded perspective view of a water-resistant connector for two connectors according to an embodiment of the present invention.

FIG. 1 shows a water-resistant cord connector 10 according to a first embodiment of the invention. The water-resistant connector 10 includes a housing 12 having a body with a bore 16 extending therethrough from a first opening 18 to a second opening 20. The first opening 18 is adapted to receive a cord (FIG. 2) through a first seal assembly comprising a nut 42, strain relief 34 and bushing 24 which provides a water-resistant seal between the cord and the first opening 18 of the housing 12. The second opening 20 is adapted to receive multiple connectors such as receptacles 50, 51 through a rubber seal 14 which provides a water-resistant seal between the receptacles and the second opening 20 of the housing 12 (FIGS. 3A-3B). The connector 10 also can be adapted to accommodate other configurations such as a single connector module, a triple receptacle module (FIG. 4), or other configurations including combinations of plugs, receptacles, fuses and other components.

Referring to the first opening 18 of the housing 12 (FIG. 1), when a cord is passed through the bore 16 of the housing 12, an annulus is formed between the bore 16 and the cord. The annulus is sealed with the first seal assembly (bushing 24, grommet 34 and nut 42) which surround the cord. The strain relief grommet 34 has a bore 33 for receiving a cord and chamfered fingers 36 to grip the cord and prevent it from slipping within the housing, without breaking the insulation of the cord, when the nut 42 is secured to the collar 15 of the second opening 18. In one embodiment, the inner surface of the bore 33 and the outer surface of the grommet 34 form an annular shape. The bushing 24 has a bore 26 to slidably receive a cord and provide a snug fit around the cord when the bushing is inserted into the bore 16. In one embodiment, the outer surface of the bushing 24 and the inner surface of the bore 26 form an annular shape. The bushing 24 has a tapered outer surface 28 along the longitudinal axis of the bushing to snugly fit within the bore 16 of the housing when the bushing 24 is urged into the bore 16 to provide a water-resistant seal between the cord and the bore 16.

In one embodiment, the bushing 24 is part of a bushing strip that detachably holds multiple bushings 24, 30, 32 each of which have a different size bore to accommodate a different cord size. Likewise, in one embodiment, the strain relief grommet 34 is part of a strain relief strip that detachably holds multiple grommets 34, 38, 40 each of which have a different size bore to accommodate a different cord size. Once a cord is selected, a bushing and strain relief is selected and detached from a respective strip to match the cord size. The unused portion can be discarded. The nut 42 has a bore extending from a first open end 44 to a second open end 46. The first end 44 is adapted to slidably receive a cord and the second end 46 has an inner surface to snugly fit over the grommet 34 and bushing 24 as well as the collar 15 on the housing 12. In one embodiment, the inner surface of the nut 42 and the outer surface of the collar 15 are threaded to provide a threaded coupling therebetween. In one embodiment, the first opening 18 and the outer and inner surfaces of the nut 42 form an annular shape. The first opening 18 of the housing 12 is rendered water-resistant by the combination of first seal assembly comprising the strain relief grommet 34, bushing 24 and nut 42. The outer surface of the nut 42 has a series of depressions 43 to improve the manipulation of the nut by hand. The chamfered fingers 36 squeeze the cord to prevent the cord from slipping from the assembly when the cord is inserted through the first seal assembly (bushing 24, grommet 34 and nut 42) and as the nut 42 is tightened around the collar 15.

Now referring to the second opening 20 of the housing 12, the rubber seal 14 has bores 70, 71 extending from an inner end 31 to an outer end 35. The rubber seal has a first outer surface 72 and a second outer surface 76 adjacent the first surface where the surfaces surround the periphery of the rubber seal 14. The first outer surface 72 is adjacent the inner end 31 and the second outer surface 76 is adjacent the outer end 35. The first outer surface 72 snugly fits within the inner surface of the second opening 20 of the housing 12 to provide a water-resistant seal between the rubber seal 14 and the housing 12. (Refer to FIGS. 3A-3B for a detailed view of the water-resistant seal) A rib 22 surrounds the periphery of the second opening 20 to snugly fit within a groove 74 surrounding the second outer surface 76 of the rubber seal 14 to provide an additional water-resistant seal between the rubber seal 14 and the housing 12. The outer surface of the housing 12 has a series of depressions 13 to improve the manipulation of the housing by hand.

The receptacles 50, 51 each have an elongated body 52 with an outer surface surrounding the body to snugly fit within an inner surface of a respective bore 70, 71 of the rubber seal 14 to provide a water-resistant seal between the inner and outer surfaces. The rubber seal 14 has a first rib 78 and a second rib 79 surrounding the second outer surface 76 and associated with a respective bore 70, 71. The receptacles 50, 51 each have a groove 60 formed on a ring 61 adjacent the outer end 55 of each receptacle. The ribs 78, 79 snugly fit within a respective groove 60 surrounding the body 52 of a respective receptacle 50, 51 to provide a water-resistant seal between the receptacles 50, 51 and the rubber seal 14. In one embodiment, the outer surface of the body 52 and the groove 60 of each of the receptacles 50, 51, the inner surface of the bores 70, 71, and the ribs 78, 79 each have an annular shape. The bores 70, 71 each have respective ribs 93, 94 extending longitudinally therethrough to snugly fit within a groove 68 on the outer surface of the body of each of the receptacles 50, 51 to align each of the receptacles 50, 51 to the rubber seal 14 and to each other. A notch 96 disposed on an outer portion of the rubber seal 14 is used for aligning the rubber seal 14 with the second opening 20 of the housing 14.

The receptacles 50, 51 each have a pair of fastening screws 69 (one shown) extending from the outer end 55 to the inner end 56 and through the body 52 of each receptacle to attach to a pair of corresponding mounting posts with threaded apertures (not shown) in the housing 12. This attachment mechanism secures the receptacles 50, 51 to the housing 12 and helps provide a water-resistant seal between the receptacles 50, 51 and the housing 12. The inner end 56 of each of the receptacles 50, 51 has wiring terminal groups 62, 64, 66 internally connected to respective contacts (not shown) on the outer end 55 where the contacts are adapted to receive a plug having three blades (not shown). In one embodiment, the terminal groups 62, 64, 66 are designated to be phase, neutral and ground terminals for connection to an alternating current (AC) power circuit. Each of the terminal groups 62, 64, 66 has a first terminal and a second terminal. The first terminal of a group is for connecting to a conductor of a cord and the second terminal of a group is for connecting, via a jumper wire, to a terminal on another receptacle within the same housing. Each terminal is defined by a circular opening and an electrical contact within the interior of the opening to receive and make electrical contact with a portion of a conductor (wire). Each of the terminal groups 62, 64, 66 has a terminal screw (only screw 63 for terminal group 62 is shown) to secure the portion of the conductor to each terminal. This terminal group 62, 64, 66 arrangement allows for the parallel electrical connection of multiple receptacles to the same power source.

Although the housing 12 is shown having openings 18, 20 on opposite sides of the housing, the openings can be disposed on the same side of the housing or have other configurations. The housing 12 can be molded of insulating material such as weather resistant and resilient natural or synthetic rubber, elastomeric or plastic. The body 52 of the receptacles 50, 51 is molded of insulating material such as synthetic rubber, Ethylene Propylene Diene Monomer (EPDM) or plastic. The other components of the connector 10, such as grommet 34, bushing 24 and nut 42, can also be made of the above materials. The housing 12 is shown affixed to receptacles 50, 51 which can be standard 3 contact electrical receptacles but other standard electrical wiring devices can be used such as 2 contact receptacles, 2 and 3 prong plugs, or a combination thereof.

Figure 2:
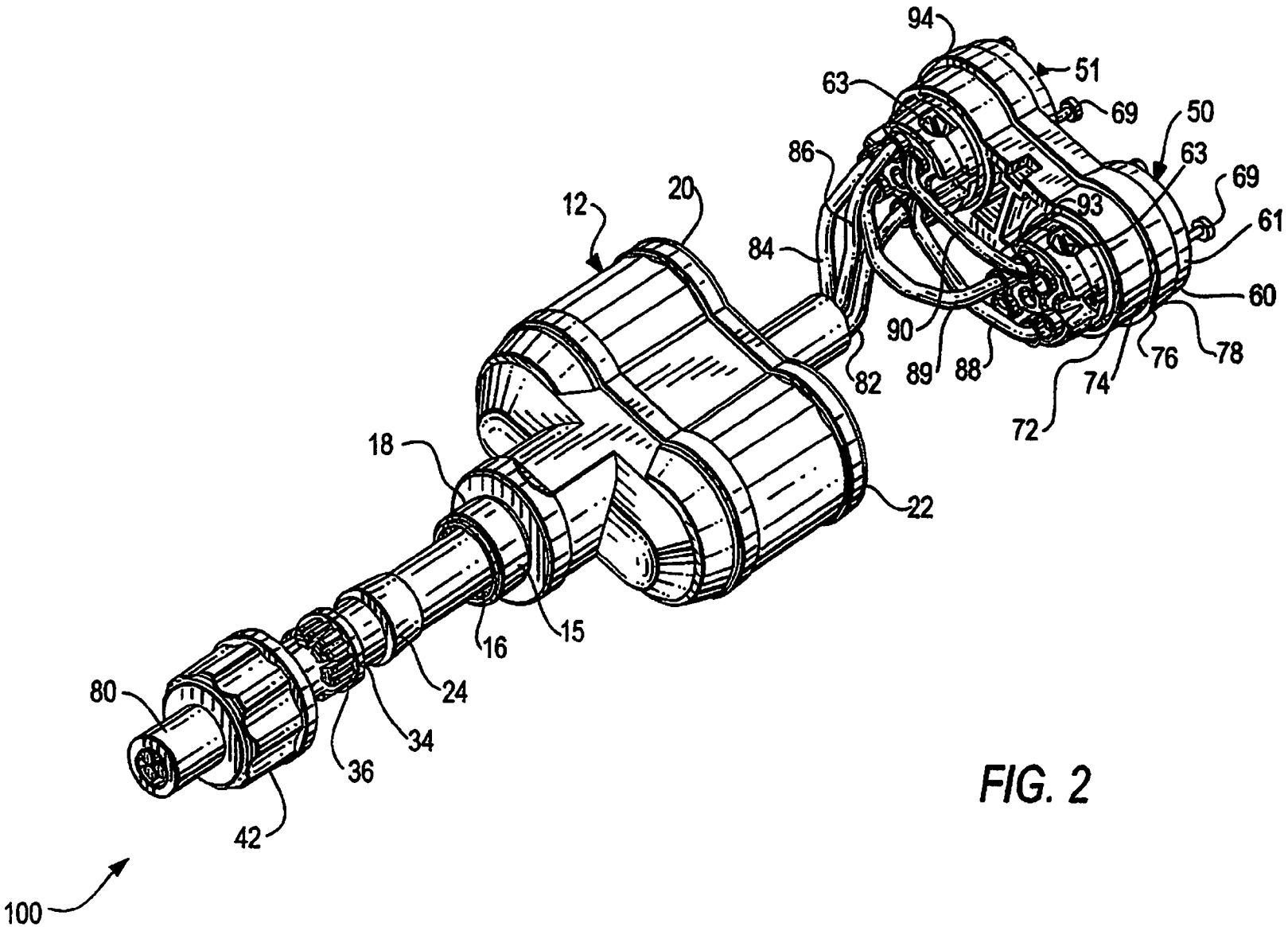
FIG. 2 is an exploded perspective view of the water-resistant connector of FIG. 1 connected to a cord.
Figure 3A:
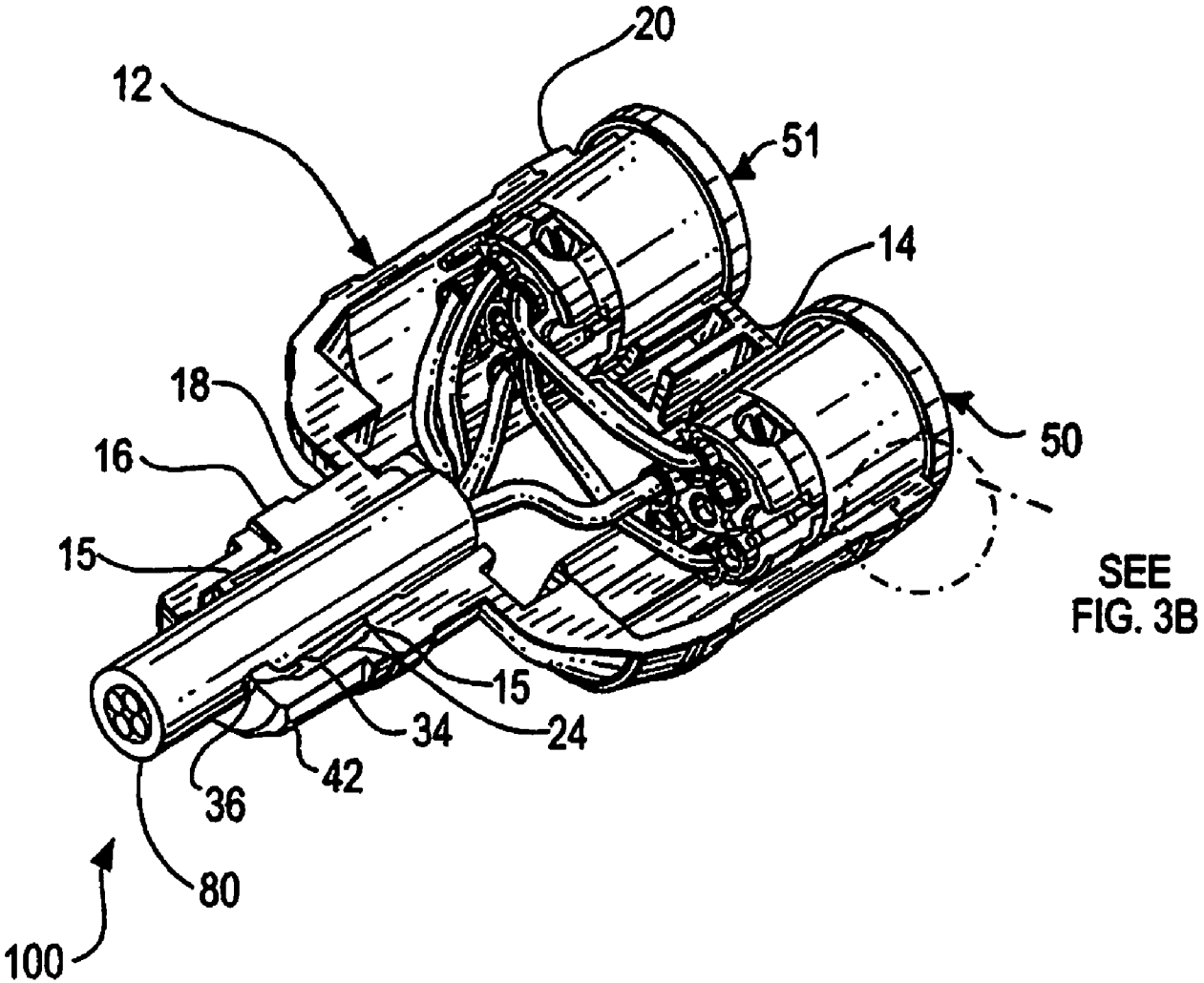
FIG. 3A is a perspective view, partially in section, of the water-resistant connector of FIG. 2 with the two connectors connected to the cord.
Figure 3B:
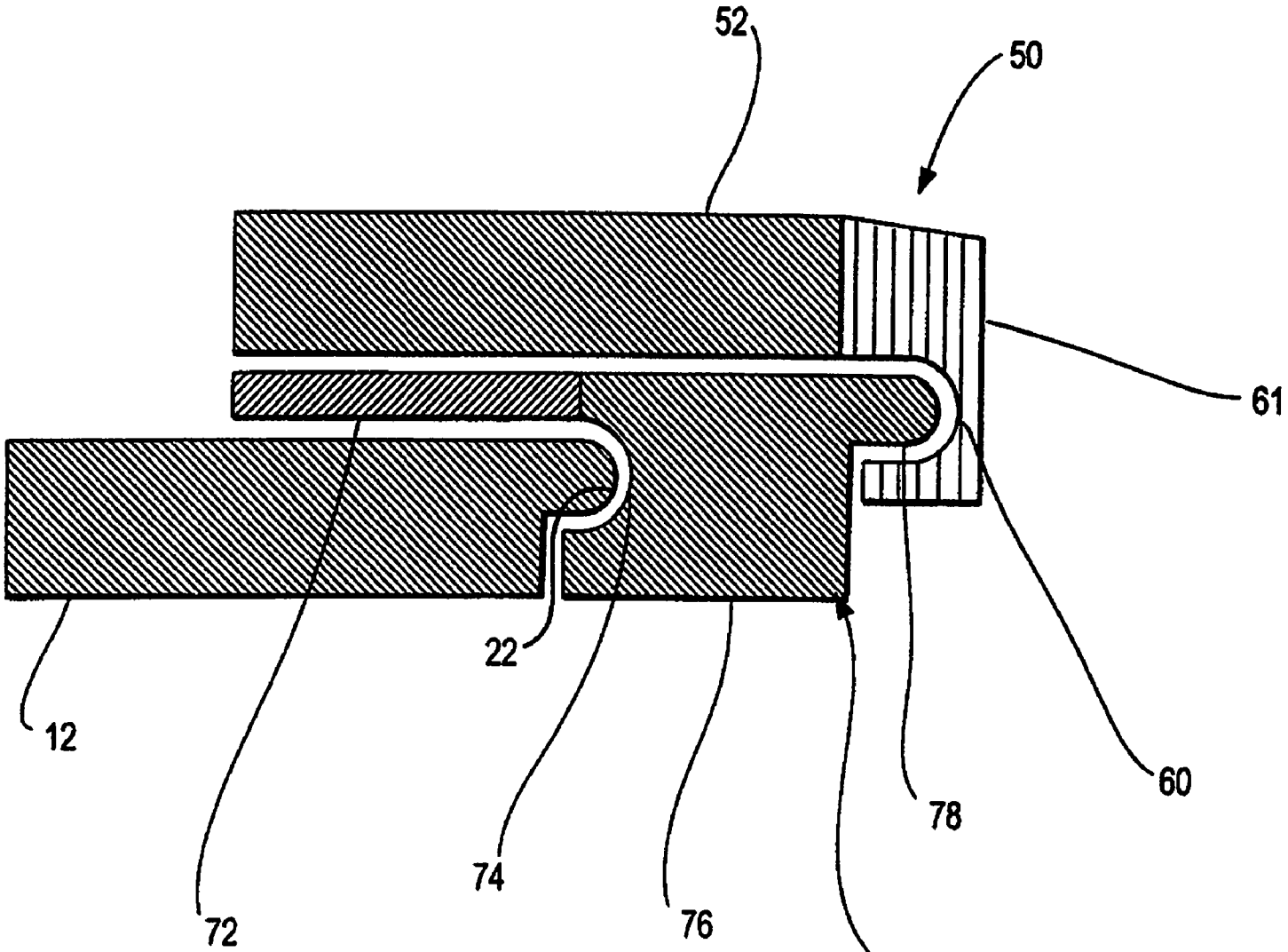
FIG. 3B is a detailed view of the water-resistant seal of the connector of FIG. 3A.

Referring to FIG. 2, shown is a partially assembled water-resistant connector 100 having receptacles 50, 51 connected to a cord 80. Referring to the first opening 18 of the housing 12, one end of the cord 80 can be attached to a plug (not shown) and the other end of the cord 80 is slidably inserted through the bore of the first seal assembly (nut 42, strain relief 34 and bushing 24), into the bore 16 of the housing 12 and extended through the second opening 20 of the housing 12. When the nut 42 is tightened around the collar 15, the fingers 36 of the strain relief 34 snugly surround the cord 80 and grip the insulation of the cord to prevent it from slipping within the housing 12. Similarly, when the nut 42 is tightened around the collar, the bushing 24 is urged into the opening 16 to snugly fit around the cord 80. Although the cord 80 is shown to have a circular shape the techniques of the present invention are also applicable to cords of other shapes such as a flat cord.

Referring to FIGS. 1 and 2, the receptacles 50, 51 are inserted into the rubber seal 14. In particular, the grooves 68 on each of the receptacles 50, 51 are aligned with a respective rib 93, 94 on a respective bore 70, 71. Once aligned, the receptacles 50, 51 are inserted into the outer end 31 of each respective bore 70, 71 of the rubber seal 14 so that the outer surface of a respective receptacle fits within the inner surface of a respective bore. The inner end 56 of each of the receptacles 50, 51 extends through the inner end 31 of a respective bore 70, 71 to allow access to the terminal groups 62, 64, 66. A portion of the outer end 55 of each of the receptacle 50, 51 protrudes through the outer end 35 of a respective bores 70, 71 to allow access to the contacts (not shown) on the outer end 55 of the receptacles. A portion of the insulation of the cord 80 is then removed to expose conductors 82, 84 and 86. Although the cord 80 is shown to have three conductors the techniques of the present invention are also applicable to cords having other numbers of conductors. The conductors 82, 84, 86 are inserted into the opening of the first terminal of a respective terminal group 62, 64, 66 of the receptacle 51. Jumper wires 88, 89, 90 are connected between the second terminal of a respective terminal group 62, 64, 66 and a corresponding terminal on the receptacle 50. The conductors and jumper wires are secured to the terminals by tightening the respective screws such as screw 63. The above feature provides a parallel electrical connection of conductors 82, 84, 86 to both receptacles 50, 51.

Once the receptacles 50, 51 are electrically connected to the conductors 82, 84, 86 of the cable 80, the assembly comprising the rubber seal 14 and receptacles can be mated to the second end 20 of the housing 12. Then the first seal assembly (nut 42, grommet 34 and bushing 24) can be mated to the first end 18 of the housing 12. Once assembled, as further described below in reference to FIGS. 3A-3B, the cord connector of the present invention provides a water-resistant seal between the between the receptacles 50, 51, the cable 80 and the housing 12.

Referring to FIG. 3A, shown are the water-resistant connector of FIG. 2 fully assembled to provide a water-resistant seal between the cord 80 and the receptacles 50, 51. Referring to the first opening 18 of the housing 12, the bore of bushing 24 surrounds the cord 80 and the tapered surface of the bushing 24 is inserted into the bore 16 to provide a snug fit between the cord 80 and the bore 16. The cord 80 fits within the bore of the nut 42 and the inner surface of the nut 42 surrounds the strain relief 36 and the bushing 24. The inner surface of the nut 42 also attaches by threads or the like to the collar 15 of the housing 12. When the nut 42 is tightened around the collar 15, the nut 42 is advanced toward the collar so that the chamfered fingers 36 of the strain relief 34 surround the cord 80 and grip the insulation of the cord to prevent it from slipping within the housing 12. The first seal assembly (nut 42, strain relief 34 and bushing 24) provide a water-resistant seal between the cord 80 and the first opening 18 of the housing 12.

Referring to FIG. 3B, shown is a detailed view of the second opening 20 of the housing 12 including the water-resistant seal between the receptacle 50, the rubber seal 14, and the housing 12. The rib 22 of the housing 12 fits snugly within the groove 74 of the rubber seal 14. The rib 78 of the rubber seal 14 fits snugly within the groove 60 on the ring 61 on the body 52 of the receptacle 50. The groove 74 is formed between the first surface 72 and the second surface 76 of the rubber seal 14. The first surface 72 of the rubber seal 14 is completely surrounded by the inner surface of the housing 12 whereas the second surface 76 is not covered by the inner surface of the housing 12. Although a detailed view of the receptacle 51 is not shown it is understood that the water-resistant seal with respect to the receptacle 50 is equally applicable to the receptacle 51.

Figure 4:
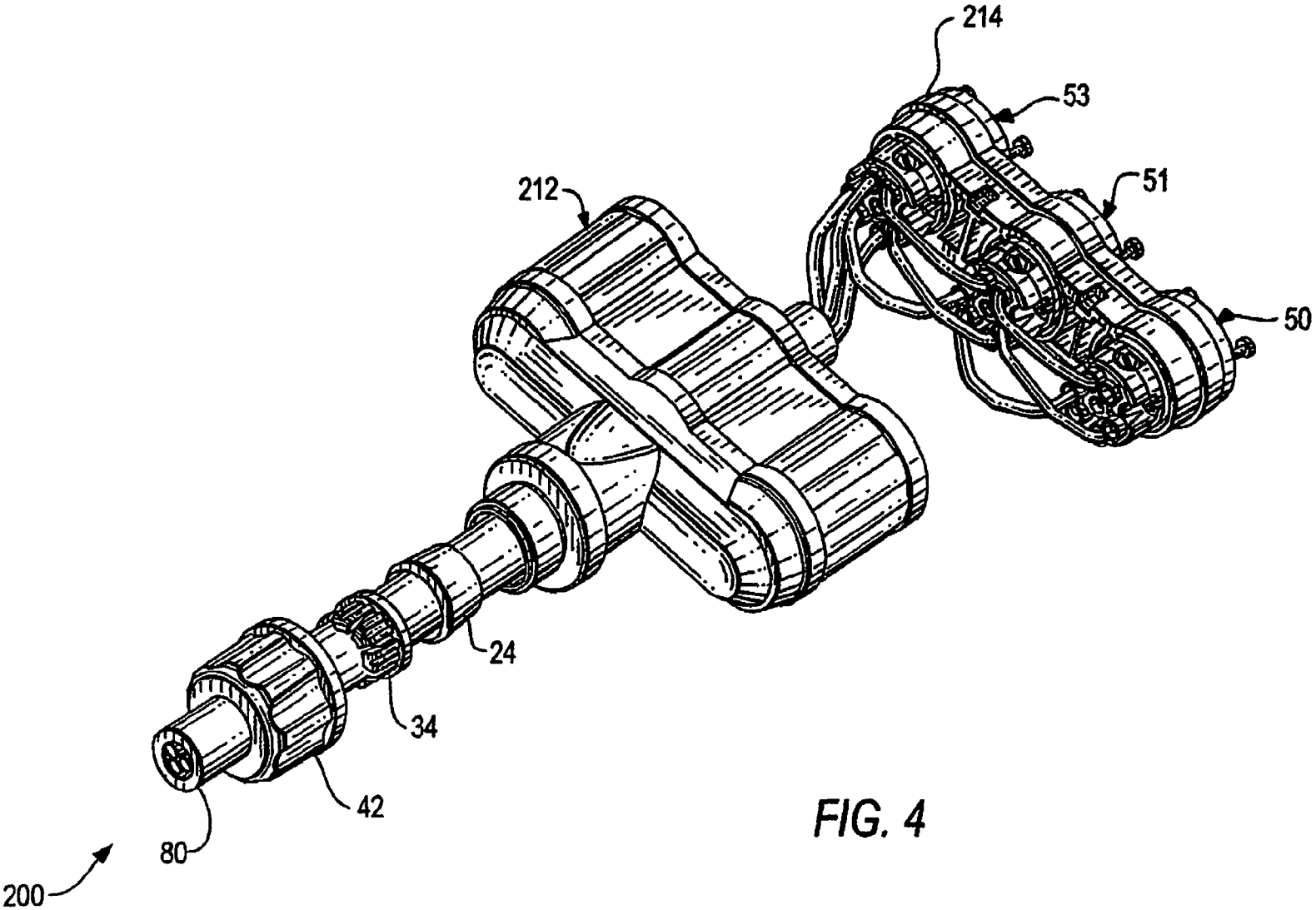
FIG. 4 is an exploded perspective view of a water-resistant connector for three connectors according to another embodiment of the present invention.

FIG. 4 is an exploded perspective view of a water-resistant cord connector 200 for supporting three connectors according to another embodiment of the present invention. The cord connector 200 comprises elements similar to those shown with respect to connector 100 depicted in FIG. 2 but whereas in FIG. 2, connector 100 is adapted for two connectors, connector 200 has a housing 212 and a rubber seal 214 adapted for three receptacles 50, 51, 53. Like the connector 100 discussed above, the cord 80 is inserted into the housing 212 and sealed with a first seal assembly comprising nut 42, strain relief 34 and bushing 24. These sealing components are the same as in FIG. 2. The cord 80 is connected to the receptacles 50, 51, 53 in a manner similar to the receptacles discussed above in conjunction with FIG. 2.

Figure 5:
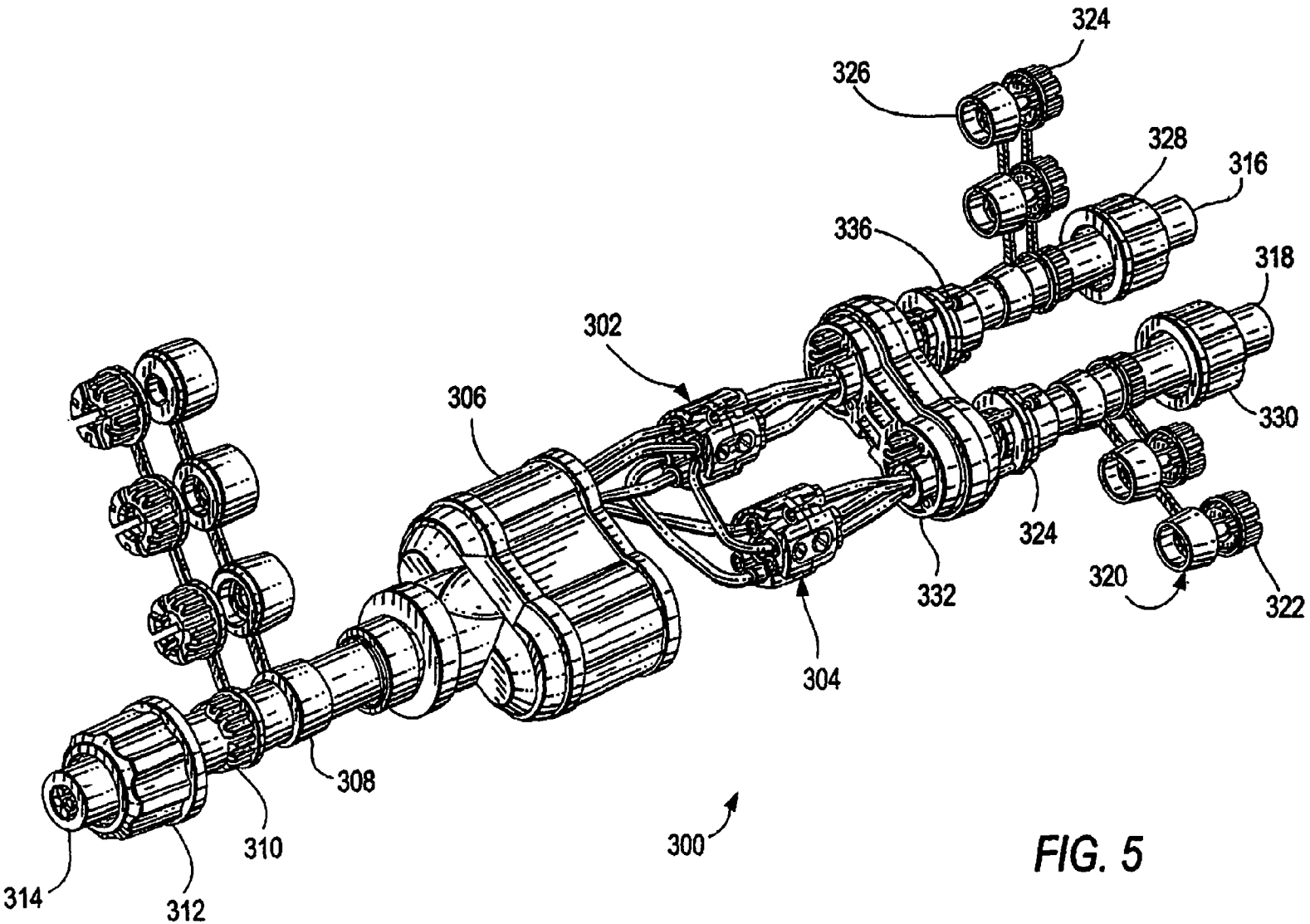
FIG. 5 is an exploded perspective view of a water-resistant connector for a two cord connection according to an embodiment of the present invention.

FIG. 5 is an exploded perspective view of a water-resistant cord connector 300 according to another embodiment of the present invention. The cord connector 300 comprises elements similar to those shown with respect to connector 100 depicted in FIG. 2 such as housing 306, bushing 308, strain relief grommet 310, nut 312 and cord 314. Like the connector 200 discussed above, the cord 314 is inserted into the housing 306 and sealed with a first seal assembly comprising nut 312, strain relief grommet 310 and bushing 308. These sealing components at the first opening are the same as in FIG. 2. However, unlike cord connector 200 which connects a cord to two connectors, cord connector 300 in FIG. 5 provides a parallel electrical connection between a single cord 314 and two cords 316, 318 via respective wiring assemblies 302, 304. Cords 314, 316, 318 are shown having 3 conductors but it should be understood that the invention is applicable to 4 or 5 conductor cords. At the other end of the cord connector 300, a water-resistant seal is provided by rubber seal 332 in combination with sealing elements (threaded bushing 336, bushing 326, grommet 324, nut 328) for cord 316 and sealing elements (threaded bushing 334, bushing 320, grommet 322, nut 330) for cord 318. To assemble, cord 316 is inserted through corresponding sealing elements (nut 328, grommet 324, bushing 326, threaded bushing 336) and respective opening in rubber seal 332 and then electrically connected to cord 314 via wiring assembly 302. A similar procedure is performed for cord 318 except that cord 318 is connected to cord 314 via wiring assembly 304. Threaded bushings 334, 336 are fastened to the rubber seal 332 using pairs of screws which are then covered by respective nuts 330, 328. It should be noted that although bushings 308, 320, 326 and grommets 310, 322, 324 are shown as part of a strip of multiple elements, it is understood that only a single element is selected from each strip during assembly.

Figure 6:
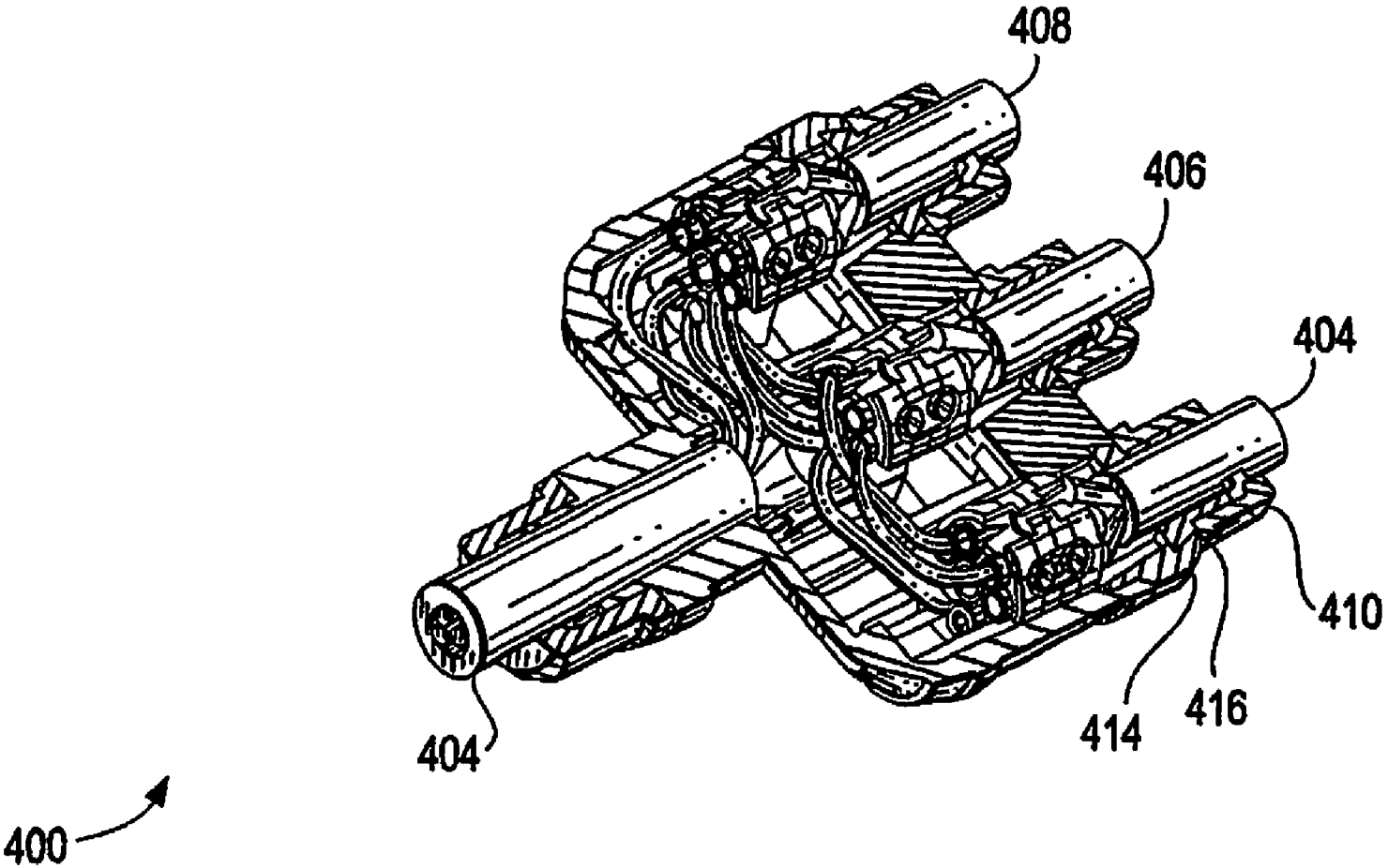
FIG. 6 is a perspective view, partially in section, of a water-resistant connector for a three cord connection according to an embodiment of the present invention.

FIG. 6 is a perspective view, partially in section, of a water-resistant cord connector 400 according to another embodiment of the present invention. The cord connector 400 is similar to the cord connector 300 of FIG. 5 except that cord connector 400 connects a single cord 402 to three cords

404, 406, 408 instead of two cords as in cord connector 300. FIG. 6 also shows further detail of the water-resistant seal between the cords 404, 406, 408 and the rubber seal 414. For example, for cord 404, threaded bushing 416 is secured to rubber seal 414 using screws and pressed by nut 410 to provide a water-resistant seal. The other cords 406, 408 are sealed in a similar manner. Thus, cord connector 300 (or 400 of FIG. 5) provides a quick and reliable means of connecting a single cord to multiple cords in a field environment and a water-resistant seal between the connectors.

While there have been shown and described and pointed out the fundamental novel features of the invention as applied to the preferred embodiments, it will be understood that various omissions and substitutions and changes of the form and details of the structures and circuits illustrated and in their operation may be made by those skilled in the art without departing from the spirit of the invention.

What is claimed is:

1. A water-resistant connector comprising:

a housing having a body with a first opening for receiving a cord and a plurality of secondary openings each adapted to receive an electrical connector, and having a rib adjacent to and surrounding the each secondary opening; and a plurality of rubber seals each having a bore extending from a first open end to a second open end, an inner surface and an outer surface, a groove surrounding the outer surface, and a rib surrounding the outer surface at the second open end of the rubber seal, wherein the outer surface of the each rubber seal fits within the each secondary opening of the housing, and a corresponding rib of the housing fits within the groove of the corresponding rubber seal the each rubber seal having a rib along a longitudinal axis of the bore and each connector has a slot, wherein the rib slidably fits within the slot to align the electrical connector within the each rubber seal, a notch is located between the rubber seals for aligning the rubber seals with the secondary openings and an outer surface of an electrical connector fits within the bore at the second open end of the rubber seal, and the electrical connector has a groove surrounding the outer surface of the body of the connector, where the rib of the rubber seal fits within the groove of the electrical connector.

2. The connector of claim 1 wherein the body of the electrical connector has an elongated shape.

3. The connector of claim 1 wherein the rib of the rubber seal has an annular shape.

4. The connector of claim 1 wherein the groove of the electrical connector has an annular shape.

5. The connector of claim 1 further comprising a bushing having a bore therethrough for passing the cord therethrough and having an outer surface, where the bore fits snugly over the cord where the outer surface fits snugly within the first opening of the housing when the bushing is inserted into the first opening.

6. The connector of claim 5 wherein the bushing is part of a plurality of bushings detachably coupled to a common holder, where each bushing has a different size bore to accommodate a different size cord.

7. The connector of claim 1 further comprising a nut having a bore therethrough for passing the cord therethrough and having an inner surface that fits snugly over a collar located adjacent the bore at the first opening of the housing.

8. The connector of claim 1 further comprising a grommet having a bore therethrough for passing the cord therethrough and where the grommet has chamfered flexible fingers to fit over the cord where the chamfered fingers grip the cord and prevent it from moving within the bore when the flexible fingers are urged toward the cord.

9. The connector of claim 8 wherein the grommet is part of a plurality of grommets detachably connected to a common holder, where each grommet has a different size bore to accommodate a different size cord.

10. The connector of claim 1 wherein the electrical connector has a plurality of terminal groups where each terminal group has a first terminal and a second terminal electrically which are connected together via a jumper.

11. The connector of claim 1 wherein the electrical connector is a standard electrical wiring receptacle.

12. The connector of claim 1 wherein the electrical connector is a standard electrical wiring plug.

13. The connector of claim 1 wherein the body of the housing has an elongated shape.

14. The connector of claim 1 wherein the body of the housing is made of insulated material.

15. The connector of claim 1 wherein the first and secondary openings of the body of the housing are located on opposite sides of the housing.

16. The connector of claim 1 wherein the outer surface of the body of the electrical connector has an annular shape.

17. The connector of claim 11 where wherein the receptacle has at least one fastener for securing the receptacle to the housing.

18. The connector of claim 11 wherein the receptacle has at least one fastener for securing a conductor to the receptacle.

* * * * *

UNITED STATES PATENT AND TRADEMARK OFFICE

CERTIFICATE OF CORRECTION

PATENT NO. : 7,285,014 B2
APPLICATION NO. : 11/299774
DATED : October 23, 2007
INVENTOR(S) : Cosmo Castaldo and Patricia Rocarro It is certified that error appears in the above-identified patent and that said Letters Patent is hereby corrected as shown below:

Title Page,

Item [73], Assignee: "Leviton Manufacturing Co., Ltd." Should read: -- Leviton Manufacturing Co., Inc. --

Signed and Sealed this

Twenty-second Day of July, 2008

JON W. DUDAS
*Director of the United States Patent and Trademark Office*